US011719426B2

(12) United States Patent
Zhuo et al.

(10) Patent No.: US 11,719,426 B2
(45) Date of Patent: Aug. 8, 2023

(54) LIGHTING APPARATUS

(71) Applicant: XIAMEN ECO LIGHTING CO. LTD., Xiamen (CN)

(72) Inventors: Zhongshun Zhuo, Xiamen (CN); Zhenyu Tang, Xiamen (CN); Shuxing Gao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 113 days.

(21) Appl. No.: 17/483,258

(22) Filed: Sep. 23, 2021

(65) Prior Publication Data

US 2022/0113015 A1 Apr. 14, 2022

(30) Foreign Application Priority Data

Oct. 14, 2020 (CN) ..... 202022287884.7
Oct. 14, 2020 (CN) ..... 202022287928.6

(51) Int. Cl.

| | |
|---|---|
| ***H01R 4/2407*** | (2018.01) |
| ***H01R 4/2445*** | (2018.01) |
| ***H01R 4/2491*** | (2018.01) |
| ***F21V 23/06*** | (2006.01) |
| ***F21V 23/00*** | (2015.01) |

(52) U.S. Cl.

CPC ..... *F21V 23/06* (2013.01); *F21V 23/007* (2013.01); *H01R 4/2407* (2018.01); *H01R 4/2445* (2013.01); *H01R 4/2491* (2013.01)

(58) Field of Classification Search

CPC ... H01R 4/2491; H01R 4/2445; H01R 4/2407
See application file for complete search history.

(56) References Cited

U.S. PATENT DOCUMENTS

| | | | | |
|---|---|---|---|---|
| 2,471,399 | A * | 5/1949 | Dodge | A01J 21/00 53/519 |
| 2,678,493 | A * | 5/1954 | Edmunds, Jr. | B26D 3/08 425/315 |
| 2,809,428 | A * | 10/1957 | Puerner | A01J 21/02 99/455 |
| 9,633,807 | B2 * | 4/2017 | Ache | H01H 33/6662 |
| 2009/0133250 | A1 * | 5/2009 | Sullivan | H01R 43/015 29/857 |
| 2010/0130053 | A1 * | 5/2010 | Ziobro | H01R 25/164 439/404 |
| 2017/0135733 | A1 * | 5/2017 | Donner | A61B 17/7049 |

* cited by examiner

*Primary Examiner* — Jean F Duverne
(74) *Attorney, Agent, or Firm* — Chun-Ming Shih; Lanway IPR Services

(57) ABSTRACT

A lighting apparatus includes a wire connector, a driver and a light source. The wire connector is used for connecting an external wire and an internal wire. The external wire includes a first external sub-wire and a second external sub-wire. The internal wire includes a first internal sub-wire and a second sub-wire. The wire connector has a scraper for cutting contact parts of the internal wire and the external wire for the first external sub-wire to be electrically connected to the first internal sub-wire and the second external sub-wire to be electrically connected to the second internal sub-wire. The driver is used for connecting to an external power via the internal wire and the external wire and for converting the external power to a driving current. The light source receives the driving current to emit a light.

20 Claims, 12 Drawing Sheets

LIGHTING APPARATUS

FIELD

The present invention is related to a lighting apparatus, and more particularly related to a lighting apparatus with a convenient connector.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

It is important to provide a light device that is easy to be installed. Wiring is a critical step for installing a light device.

Usually, people need to remove an insulation layer from a wire to be electrically connect to another wire, e.g. with tape, for performing electrical connection among components.

Therefore, it is beneficial to provide a smart design to solve such problem.

SUMMARY

In some embodiments, a lighting apparatus includes a wire connector, a driver and a light source.

The wire connector is used for connecting an external wire and an internal wire.

The external wire includes a first external sub-wire and a second external sub-wire.

The internal wire includes a first internal sub-wire and a second sub-wire.

The wire connector has a scraper for cutting contact parts of the internal wire and the external wire for the first external sub-wire to be electrically connected to the first internal sub-wire and the second external sub-wire to be electrically connected to the second internal sub-wire.

The driver is used for connecting to an external power via the internal wire and the external wire and for converting the external power to a driving current.

The light source receives the driving current to emit a light.

In some embodiments, the wire connector has a top part for guiding the external wire.

The wire connector has a bottom part for guiding the internal wire.

When the top part and the bottom part are connected, the scraper are used to remove parts of insulation layers of the external wire and the internal wire and push the external wire and the internal wire to contact.

In some embodiments, scraper has a first top cutter, a second top cutter and a bottom cutter.

The first top cutter and the second top cutter are disposed in the top part and the bottom cutter is disposed in the bottom part.

In some embodiments, the first top cutter cuts and connects the first external sub-wire and the first internal sub-wire.

The second top cutter cuts the second external sub-wire.

The bottom cutter cuts the second internal sub-wire.

The second top cutter connects the second external sub-wire and the second internal sub-wire.

In some embodiments, the second top cutter is longer than the first top cutter.

The bottom cutter has a plugging clip for inserting a bottom end of the second top cutter for electrically connecting the second external sub-wire to the second internal sub-wire.

In some embodiments, the first top cutter, the second top cutter and the bottom cutter are metal pieces.

In some embodiments, the top part has a fixing unit for disposing the first top cutter and the second top cutter.

The top part has a top cover for containing the fixing unit.

In some embodiments, the fixing unit has a wire cavity for pressing the first top cutter and the first external sub-wire to engage each other.

In some embodiments, the bottom part has a wire groove for placing a connecting part of the internal wire.

When the top cover is connected to the second cover, the connecting part is concealed by the top part and the bottom part.

In some embodiments, the top part and the bottom part are connected with a screw structure.

When the top part is connected to the bottom part, the scraper is actuated to cut the contact parts of the internal wire and the external wire.

In some embodiments, the fixing unit is made of an insulation material for electrically insulating the first internal sub-wire and the first external sub-wire from the second internal sub-wire and the second external sub-wire.

In some embodiments, the screw structure is a nut with an internal screw groove corresponding to a bolt of a bottom part.

In some embodiments, the wire groove is formed at a center of the bolt.

The bolt forms two lateral walls of the wire groove.

In some embodiments, the fixing unit has a second wire entrance with a smaller diameter than a first wire entrance of the top cover.

In some embodiments, the external wire has a first external part and a second external part.

The second external part has a larger diameter than the first external part.

The first external part is inserted into the top cover.

In some embodiments, the first top cutter has a saw-tooth structure.

In some embodiments, the bottom part is fixed on a driver box.

The driver box is used for storing the driver.

In some embodiments, the top part has a reverse hook for preventing the external wire escape from the top part.

In some embodiments, the top part has an elastic unit for pressing the external wire to the internal wire.

In some embodiments, the wire connector has a buckle to attach to a driver box.

The driver box is used for storing the driver.

DETAILED DESCRIPTION

Figure 19:
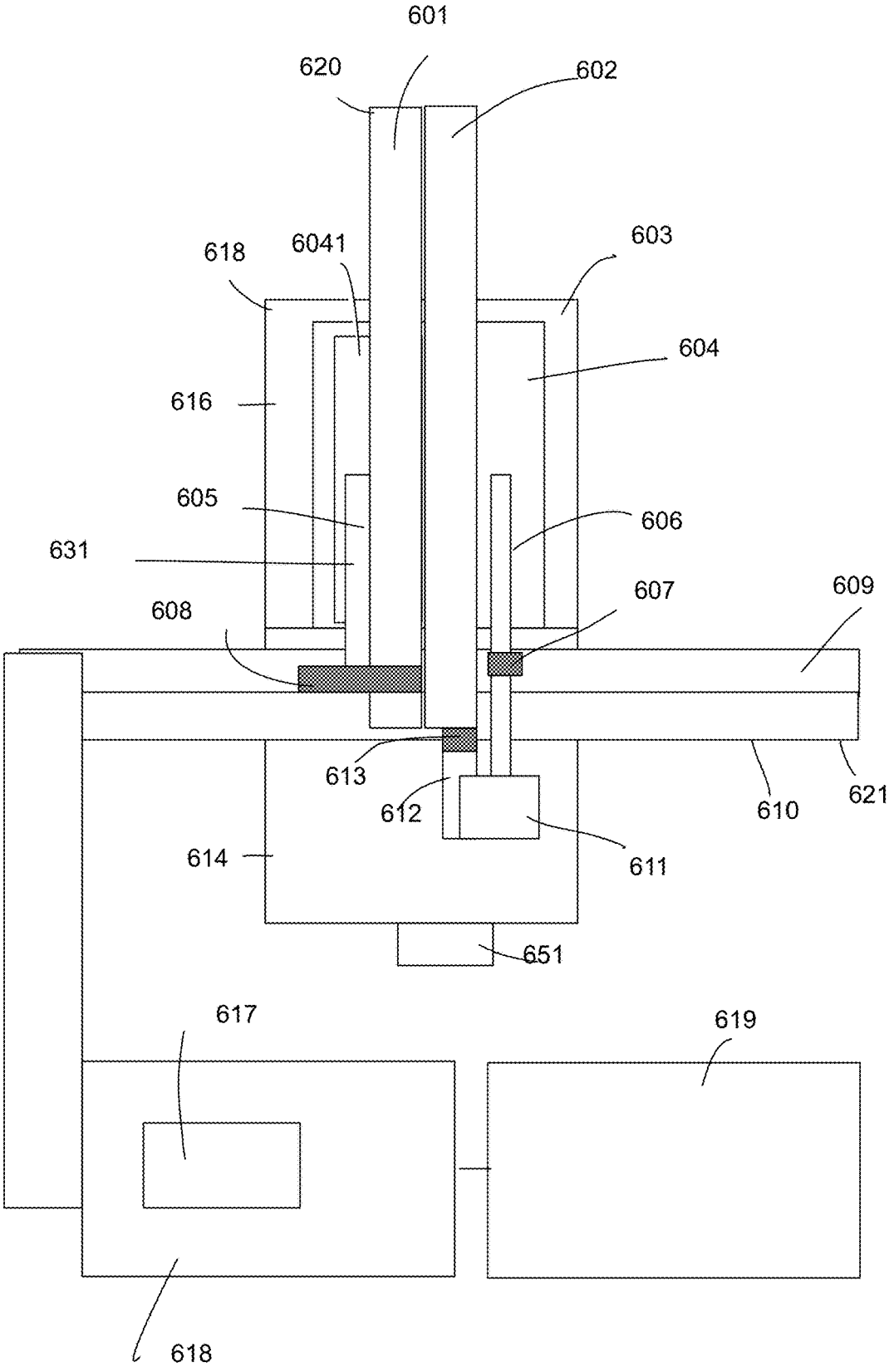
FIG. 19 shows another lighting apparatus embodiment.

In FIG. 19, a lighting apparatus includes a wire connector 618, a driver 617 and a light source 619.

The wire connector 618 is used for connecting an external wire 620 and an internal wire 621.

The external wire 620 includes a first external sub-wire 601 and a second external sub-wire 602.

The internal wire 621 includes a first internal sub-wire 609 and a second sub-wire 610.

The wire connector 618 has a scraper 631 for cutting contact parts 608, 607, 612 of the internal wire 621 and the external wire 620 for the first external sub-wire 620 to be electrically connected to the first internal sub-wire 609 and the second external sub-wire 602 to be electrically connected to the second internal sub-wire 610.

The driver 617 is used for connecting to an external power via the internal wire 621 and the external wire 601 and for converting the external power to a driving current.

The light source 619 receives the driving current to emit a light. For example, the light source may include a downlight housing, a light source plate and a light passing cover to be fixed to junction box. The driver 617 may be placed in a driver box 618 attached to the downlight housing. The external wire 618 is connected to an inhouse power source, e.g. 110V AC power. The internal wire 621 is connected to the driver 617 via the connection of the wire connector 618.

The wire connector 618 provides a convenient and safe way to connect wires. Please be noted that the wire connector 618 may be disposed in another place for connecting two components. For example, the driver may have multiple parts with different functions. The wire connector mentioned here may be used in connecting these parts in other embodiments.

In FIG. 19, the wire connector 618 has a top part 616 for guiding the external wire 620.

The wire connector 618 has a bottom part 614 for guiding the internal wire 621.

When the top part 616 and the bottom part 614 are connected, the scraper 631 are used to remove parts of insulation layers of the external wire 620 and the internal wire 621 and push the external wire 620 and the internal wire 621 to contact. For example, the scraper 631 has one or more than one cut unit for removing or cutting surface of the insulation layer to expose the metal part of the external wire 620 and the internal wire 621. In addition, the wire connector 618 provides a force to keep the exposed metal parts of the external wire 620 and the internal wire 621 to engage to perform an electrical connection.

In some embodiments, scraper 631 has a first top cutter 605, a second top cutter 606 and a bottom cutter 612.

The first top cutter 605 and the second top cutter 606 are disposed in the top part 616 and the bottom cutter 612 is disposed in the bottom part 614.

In some embodiments, the first top cutter 605 cuts and connects the first external sub-wire 601 and the first internal sub-wire 609.

The second top cutter 606 cuts the second external sub-wire 602.

The bottom cutter 612 cuts the second internal sub-wire 610.

The second top cutter 606 connects the second external sub-wire 602 and the second internal sub-wire 610.

In some embodiments, the second top cutter 606 is longer than the first top cutter 605.

The bottom cutter 612 has a plugging clip 611 for inserting a bottom end of the second top cutter 606 for electrically connecting the second external sub-wire 602 to the second internal sub-wire 610.

In some embodiments, the first top cutter 605, the second top cutter 606 and the bottom cutter 612 are metal pieces.

In some embodiments, the top part 616 has a fixing unit 604 for disposing the first top cutter 605 and the second top cutter 606.

The top part 616 has a top cover 603 for containing the fixing unit 604.

In some embodiments, the fixing unit 604 has a wire cavity 6041 for pressing the first top cutter 605 and the first external sub-wire 601 to engage each other. For example, the wire cavity 6041 may be a tube structure for holding the wire and the first top cutter 605.

In some embodiments, the bottom part 614 has a wire groove for placing a connecting part of the internal wire 621.

Figure 13:
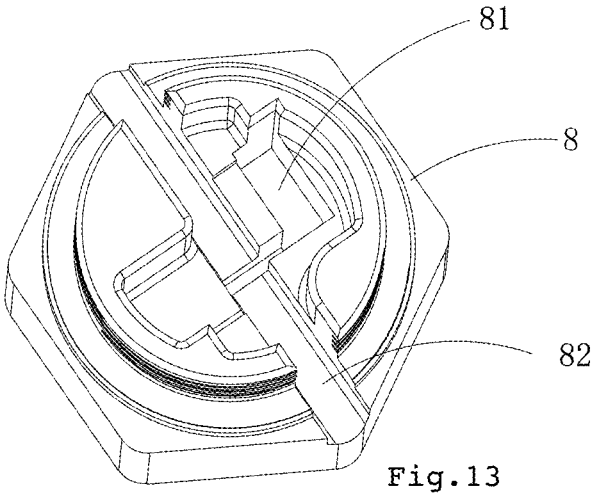
FIG. 13 illustrates a bottom part example.

FIG. 13 shows an example of a bottom part 8 that has a wire groove with two lateral walls for placing the internal wire in the wire groove.

When the top cover is connected to the second cover, the connecting part is concealed by the top part and the bottom part.

Figure 1:
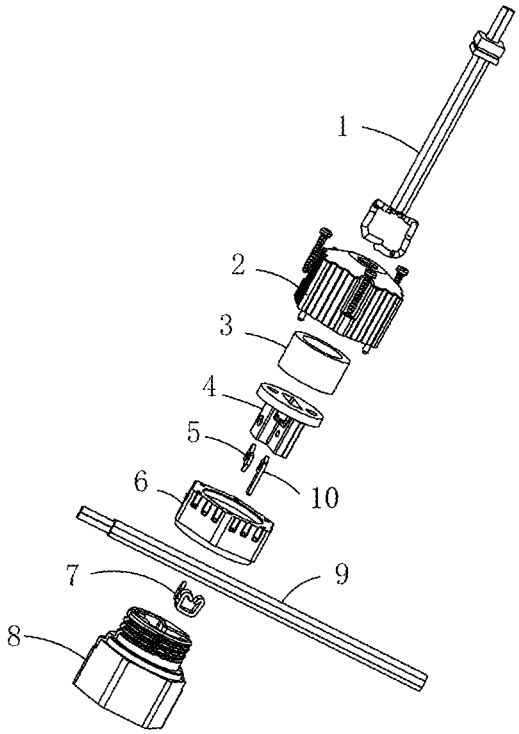
FIG. 1 illustrates an exploded view of a wire connector used in a lighting apparatus.
Figure 2:
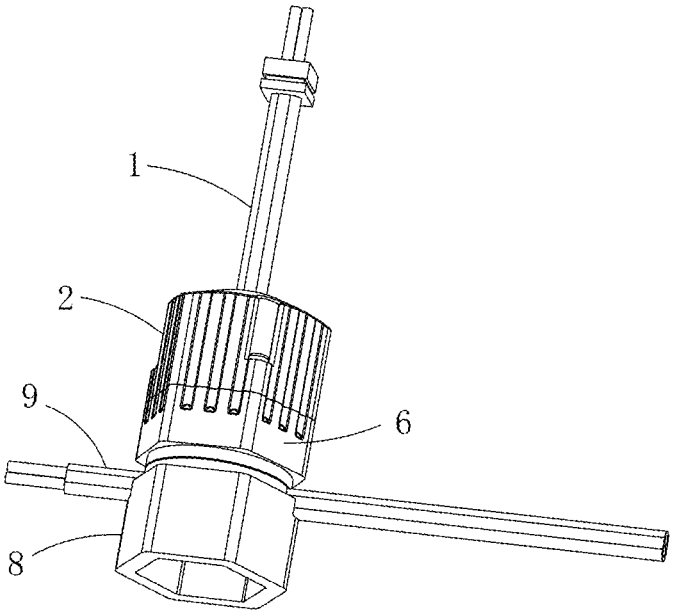
FIG. 2 illustrates another view of the example in FIG. 1.

FIG. 1 and FIG. 2 show such an example. The internal wire 9 is partly concealed by the connection of the top part and the bottom part 8.

In FIG. 1, the top part includes the top cover 2, the fixing unit 4, the first top cutter 5, the second top cutter 10 and the bottom part 8. There is a rotation ring 3 for providing the top cover 2 to rotate to lock to the nut 6 for pressing the first top cutter 5, the second top cutter 10 and the bottom cutter 7 to cut external insulation surface of the external wire 1 and the internal wire 9 to keep the external wire 1 and the internal wire 9 to be electrically connected.

FIG. 2 shows a status that the components in FIG. 1 are assembled.

In some embodiments, the top part and the bottom part are connected with a screw structure, as illustrated in FIG. 1 and FIG. 2.

When the top part is connected to the bottom part, the scraper is actuated to cut the contact parts of the internal wire and the external wire.

In some embodiments, the fixing unit is made of an insulation material for electrically insulating the first internal sub-wire and the first external sub-wire from the second internal sub-wire and the second external sub-wire.

In some embodiments, the screw structure is a nut with an internal screw groove corresponding to a bolt of a bottom part, as illustrated in FIG. 1 and FIG. 2.

In some embodiments, the wire groove 82 is formed at a center of the bolt, as illustrated in FIG. 13.

The bolt forms two lateral walls of the wire groove, as shown in FIG. 13.

In some embodiments, the fixing unit 3 has a second wire entrance 31 with a smaller diameter than a first wire entrance of the top cover. For example, the first wire entrance of the top cover is larger or with a circular shape, but the external wire is in flat shape, instead of a circular shape. Such design prevents water to move into the wire connector because of an escape due to inconsistent size of the wire and the entrance.

In some embodiments, the external wire has a first external part and a second external part.

The second external part has a larger diameter than the first external part.

The first external part is inserted into the top cover. For example, the external wire may have a flat shape in most part but has a front end with a larger diameter so as to fit in the wire connector closely to prevent water to move in the wire connector.

Figure 20:
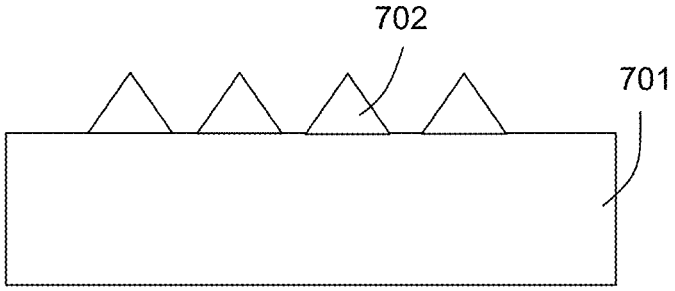
FIG. 20 shows a cutter example.

In FIG. 20, the first top cutter 701 has a saw-tooth structure 702.

Figure 21:
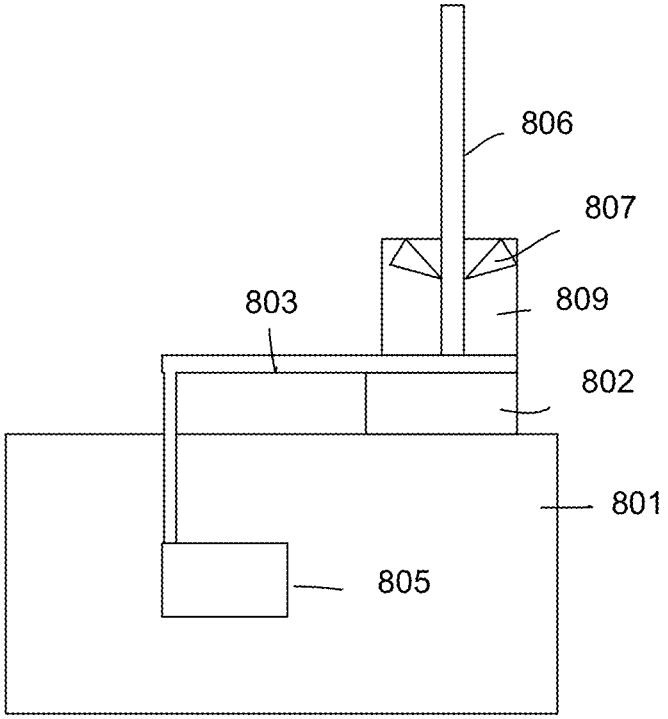
FIG. 21 shows another embodiment.

In FIG. 21, the bottom part 802 is fixed on a driver box 801.

The driver box 801 is used for storing the driver 805 which connects to an internal wire 803 that is further connected to an external wire 806.

In some embodiments, the top part 809 has a reverse hook 807 for preventing the external wire 806 escape from the top part 809.

In some embodiments, the top part has an elastic unit for pressing the external wire to the internal wire. For example, an elastic rubber pad may be disposed adjacent to the first top cutter.

In FIG. 19, the wire connector has a buckle 651 to attach to a driver box 618.

The driver box 618 is used for storing the driver 617.

Please refer to FIG. 3 to FIG. 18, which show detailed aspects of the example in FIG. 1 and FIG. 2 mentioned above. The same reference numerals refer to the same components and may not be repeated for describing the following drawings.

Figure 3:
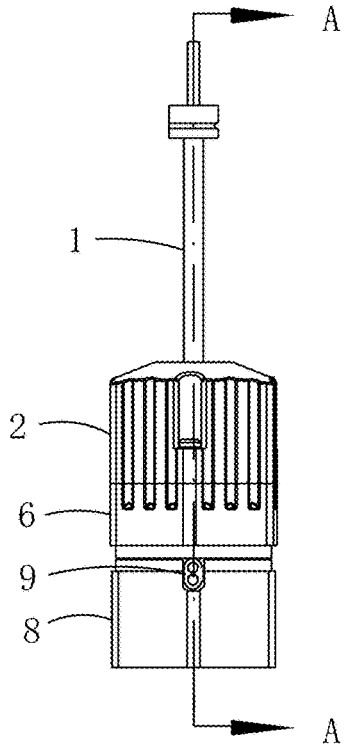
FIG. 3 illustrates a side view of the example in FIG. 1.

FIG. 3 shows a side view of the example in FIG. 1 and FIG. 2.

Figure 4:
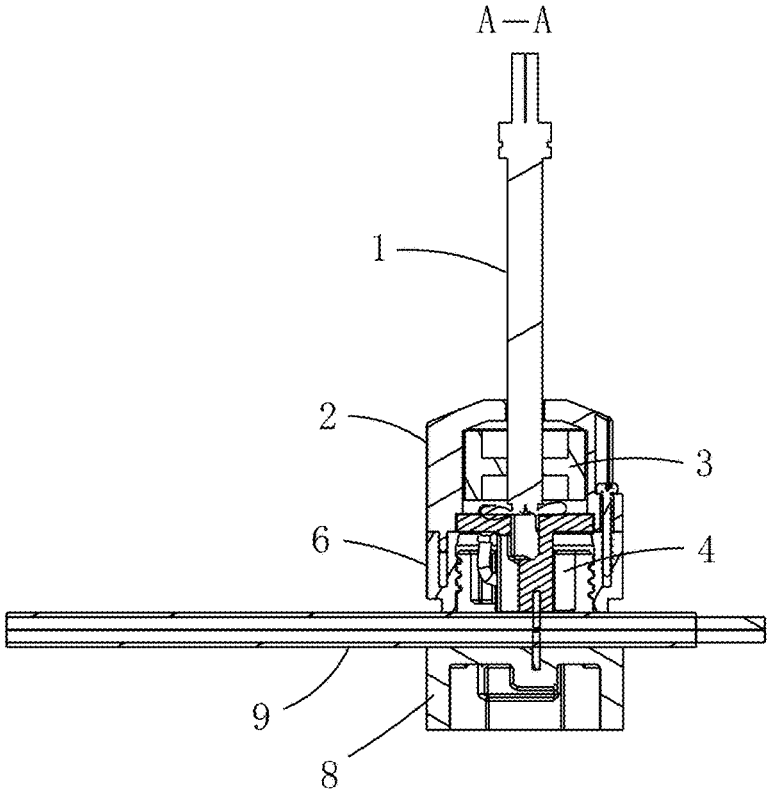
FIG. 4 illustrates a cross-sectional view of the example in FIG. 1.

FIG. 4 shows a cross-sectional view of the example in FIG. 1 and FIG. 2.

Figure 5:
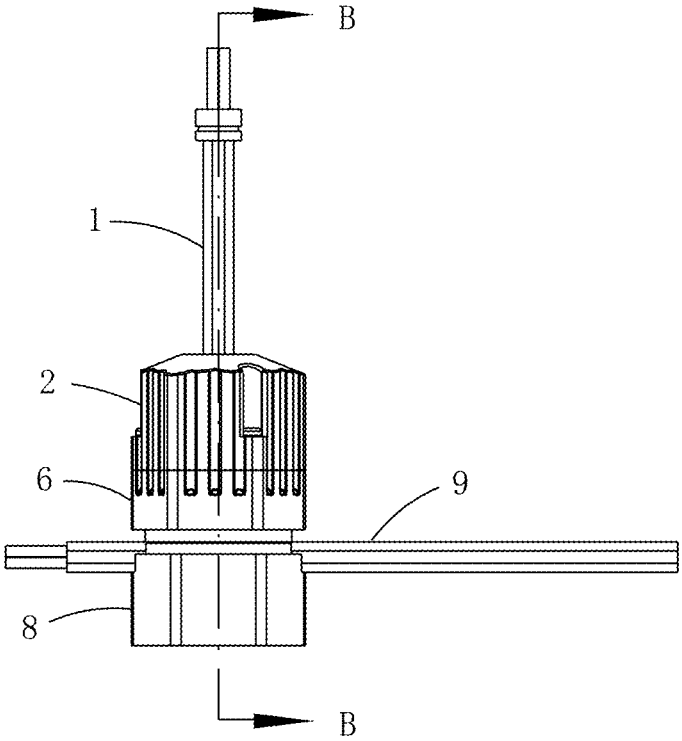
FIG. 5 illustrates another view of the example in FIG. 1.

FIG. 5 shows another view of the example in FIG. 1 and FIG. 2.

Figure 6:
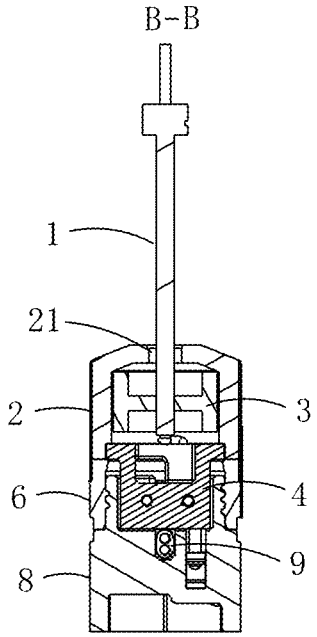
FIG. 6 illustrates another cross-sectional view of the example in FIG. 1.

FIG. 6 further shows a first wire entrance 21 in the top cover 3. When the external wire is not fitting the first entrance 21, e.g. leaving escape, the fixing unit may have a narrower entrance to prevent water to move into the wire connector.

Figure 7:
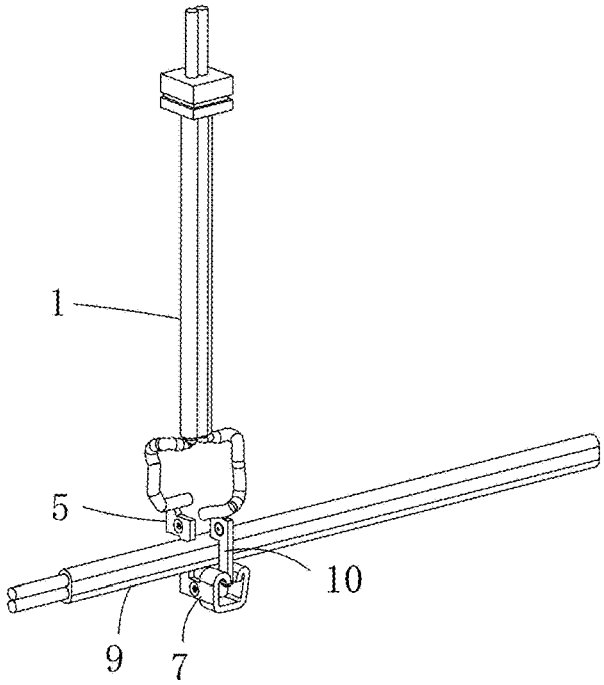
FIG. 7 illustrates a diagram illustrating an external wire and an internal wire in the example of FIG. 1.

FIG. 7 shows a relation of the first top cutter 5, the second top cutter 10 and the bottom cutter 7. The second top cutter 10 has an extended part as a medium for routing electricity from the second external sub-wire to the second internal sub-wire that is via the bottom cutter 7.

Figure 8:
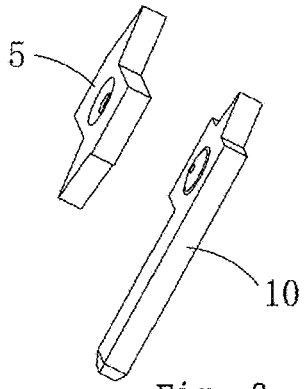
FIG. 8 illustrates a first top cutter example and a second top cutter example.

FIG. 8 shows a zoom-up view of the first top cutter 5 and the second top cutter 10.

Figure 9:
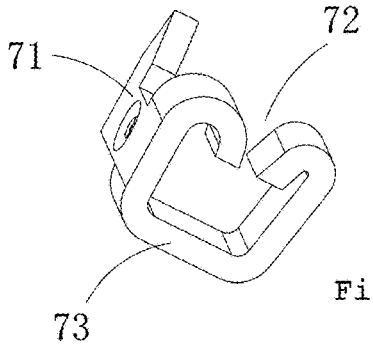
FIG. 9 illustrates a bottom cutter example.

FIG. 9 shows a zoom-up view of the bottom cutter that has a base 73 with an elastic clip 72 for inserting a bottom end of the second top cutter. There is a cut part 71 for cutting the internal wire to exposed the metal part.

Figure 10:
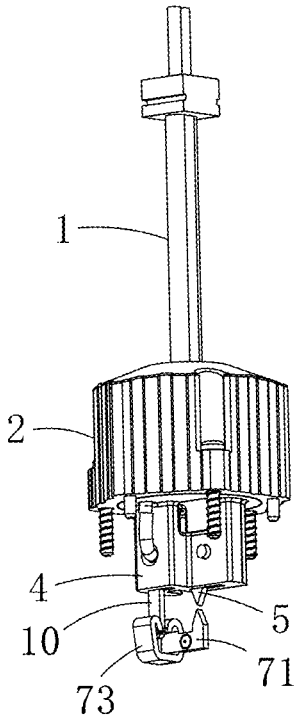
FIG. 10 illustrates a partially assembled view of the example in FIG. 1.

FIG. 10 shows another view of the example in FIG. 1 and FIG. 9.

Figure 11:
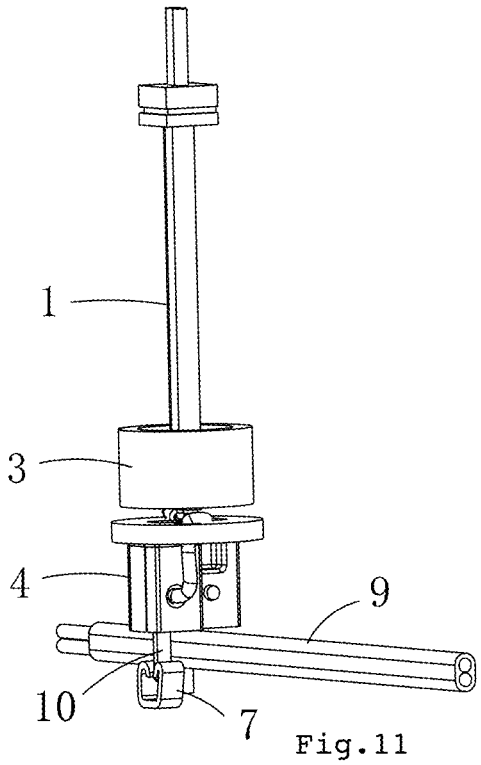
FIG. 11 illustrates another view of the example in FIG. 10.

FIG. 11 shows another view when some components are removed for showing the details.

Figure 12:
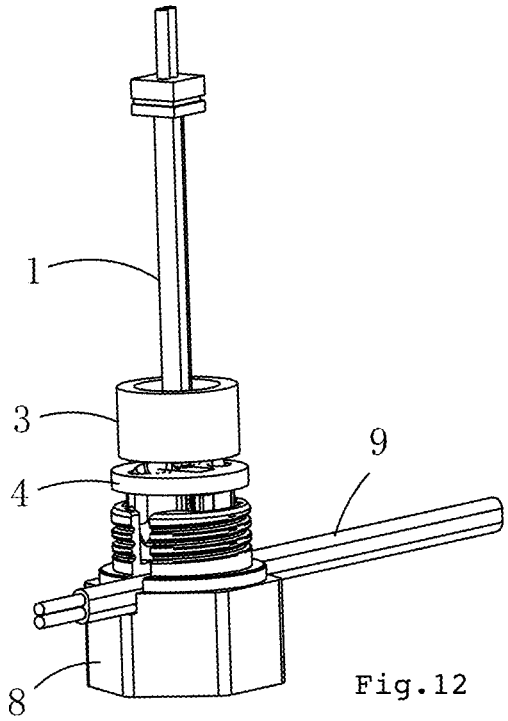
FIG. 12 illustrates a status example during assembly.

FIG. 12 shows an example in FIG. 1 and FIG. 2 by removing the top cover to see the details of the inside structure.

FIG. 13 shows a bottom part 8 with the wire groove 82 and a container 81 for placing the bottom cutter.

Figure 14:
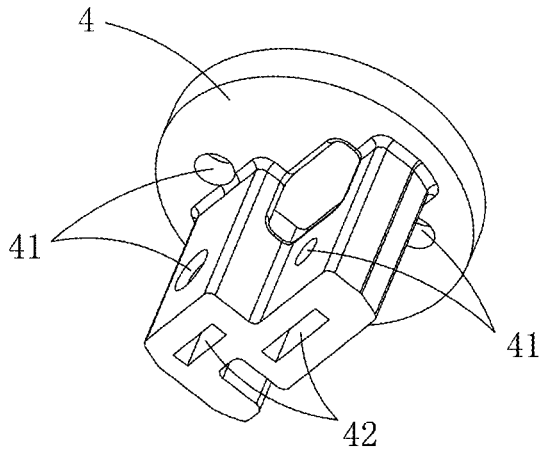
FIG. 14 illustrates a top part example.

FIG. 14 shows a fixing unit 4 with holes 41 for inserting the external wire and containers 42 for fitting the first top cutter and the second top cutter.

Figure 15:
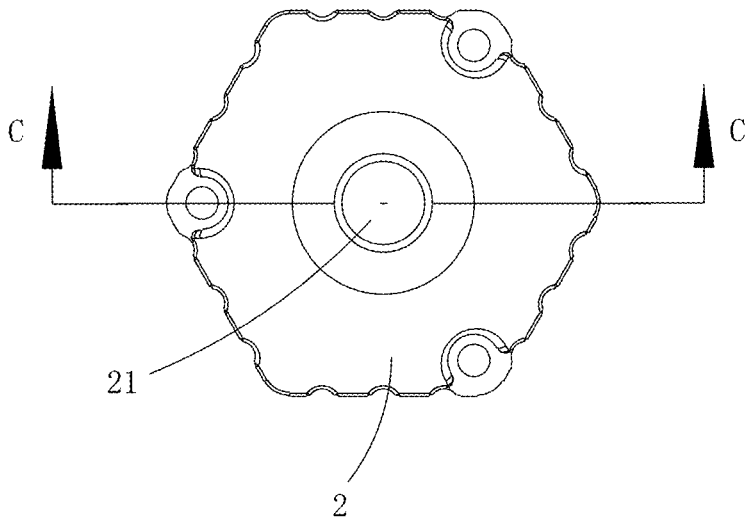
FIG. 15 illustrates a top cover example

FIG. 15 shows a top view of the top cover 2 with a first wire entrance 21.

Figure 16:
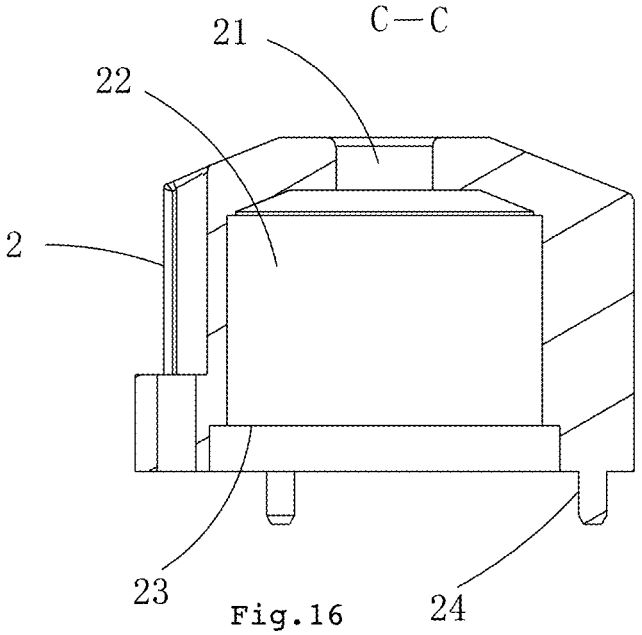
FIG. 16 illustrates a cross-sectional view of a top part.

FIG. 16 shows a top cover 2 with a container 21 for inserting the fixing unit. There is a bottom cover 23 and a pin 24 for connecting to the bottom part.

Figure 17:
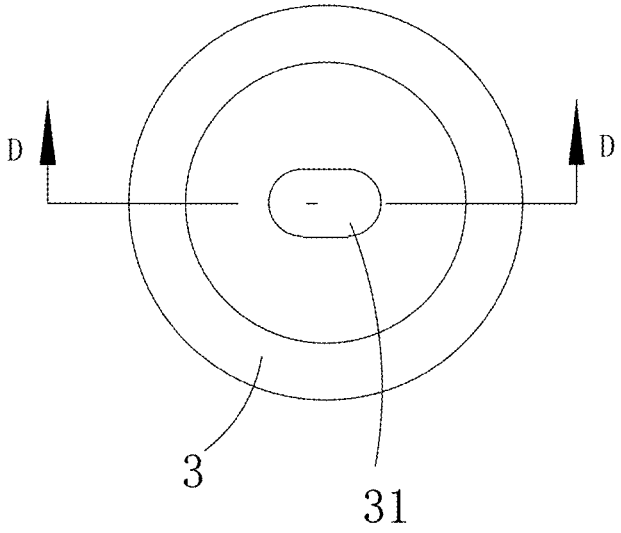
FIG. 17 illustrates a fixing unit example.

FIG. 17 shows a second entrance 31 in the rotation ring 3, which may also be formed on the fixing unit.

Figure 18:
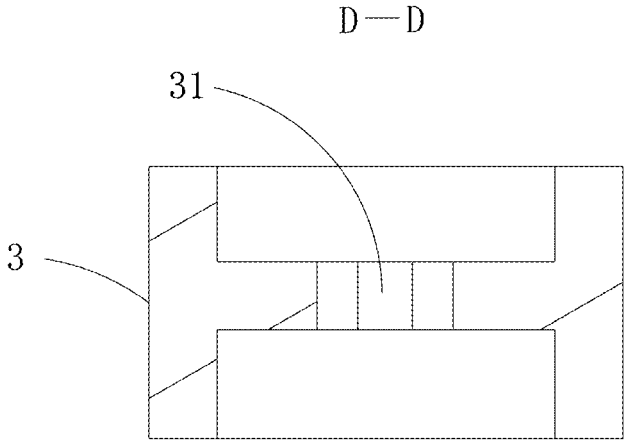
FIG. 18 illustrates a wire insertion structure example.

FIG. 18 shows a rotation ring 3 with a wire passage 31.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a wire connector for connecting an external wire and an internal wire, wherein the external wire comprises a first external sub-wire and a second external sub-wire, wherein the internal wire comprises a first internal sub-wire and a second sub-wire, wherein the wire connector has a scraper for cutting contact parts of the internal wire and the external wire for the first external sub-wire to be electrically connected to the first internal sub-wire and the second external sub-wire to be electrically connected to the second internal sub-wire;

a driver for connecting to an external power via the internal wire and the external wire and for converting the external power to a driving current; and a light source for receiving the driving current to emit a light.

2. The lighting apparatus of claim 1, wherein the wire connector has a top part for guiding the external wire, wherein the wire connector has a bottom part for guiding the internal wire, wherein when the top part and the bottom part are connected, the scraper are used to remove parts of insulation layers of the external wire and the internal wire and push the external wire and the internal wire to contact.

3. The lighting apparatus of claim 2, wherein scraper has a first top cutter, a second top cutter and a bottom cutter, wherein the first top cutter and the second top cutter are disposed in the top part and the bottom cutter is disposed in the bottom part.

4. The lighting apparatus of claim 3, wherein the first top cutter cuts and connects the first external sub-wire and the first internal sub-wire, wherein the second top cutter cuts the second external sub-wire, wherein the bottom cutter cuts the second internal sub-wire, wherein the second top cutter connects the second external sub-wire and the second internal sub-wire.

5. The lighting apparatus of claim 4, wherein the second top cutter is longer than the first top cutter, wherein the bottom cutter has a plugging clip for inserting a bottom end of the second top cutter for electrically connecting the second external sub-wire to the second internal sub-wire.

6. The lighting apparatus of claim 5, wherein the first top cutter, the second top cutter and the bottom cutter are metal pieces.

7. The lighting apparatus of claim 4, wherein the top part has a fixing unit for disposing the first top cutter and the second top cutter, wherein the top part has a top cover for containing the fixing unit.

8. The lighting apparatus of claim 7, wherein the fixing unit has a wire cavity for pressing the first top cutter and the first external sub-wire to engage each other.

9. The lighting apparatus of claim 7, wherein the bottom part has a wire groove for placing a connecting part of the internal wire, wherein when the top cover is connected to the second cover, the connecting part is concealed by the top part and the bottom part.

10. The lighting apparatus of claim 9, wherein the top part and the bottom part are connected with a screw structure, wherein when the top part is connected to the bottom part, the scraper is actuated to cut the contact parts of the internal wire and the external wire.

11. The lighting apparatus of claim 10, wherein the fixing unit is made of an insulation material for electrically insulating the first internal sub-wire and the first external sub-wire from the second internal sub-wire and the second external sub-wire.

12. The lighting apparatus of claim 11, wherein the screw structure is a nut with an internal screw groove corresponding to a bolt of a bottom part.

13. The lighting apparatus of claim 12, wherein the wire groove is formed at a center of the bolt, wherein the bolt forms two lateral walls of the wire groove.

14. The lighting apparatus of claim 12, wherein the fixing unit has a second wire entrance with a smaller diameter than a first wire entrance of the top cover.

15. The lighting apparatus of claim 12, wherein the external wire has a first external part and a second external part, wherein the second external part has a larger diameter than the first external part, wherein the first external part is inserted into the top cover.

16. The lighting apparatus of claim 3, wherein the first top cutter has a saw-tooth structure.

17. The lighting apparatus of claim 2, wherein the bottom part is fixed on a driver box, wherein the driver box is used for storing the driver.

18. The lighting apparatus of claim 2, wherein the top part has a reverse hook for preventing the external wire escape from the top part.

19. The lighting apparatus of claim 2, wherein the top part has an elastic unit for pressing the external wire to the internal wire.

20. The lighting apparatus of claim 1, wherein the wire connector has a buckle to attach to a driver box, wherein the driver box is used for storing the driver.

* * * * *